US006663350B2

(12) United States Patent
Tyree, Jr.

(10) Patent No.: US 6,663,350 B2
(45) Date of Patent: Dec. 16, 2003

(54) SELF GENERATING LIFT CRYOGENIC PUMP FOR MOBILE LNG FUEL SUPPLY SYSTEM

(76) Inventor: Lewis Tyree, Jr., 115 Liberty Hall Rd., Lexington, VA (US) 24450

( * ) Notice: Subject to any disclaimer, the term of this patent is extended or adjusted under 35 U.S.C. 154(b) by 57 days.

(21) Appl. No.: 09/994,206

(22) Filed: Nov. 26, 2001

(65) Prior Publication Data

US 2003/0097847 A1 May 29, 2003

(51) Int. Cl.[7] ..... F04B 49/02; F04B 49/025; F04B 49/03; F04B 23/04; F17C 13/00

(52) U.S. Cl. ..... 417/53; 417/213; 417/286; 417/297.5; 417/298; 417/521; 62/50.6

(58) Field of Search ..... 417/53, 297.5, 417/213, 286, 298, 521; 62/48.1, 50.6

(56) References Cited

U.S. PATENT DOCUMENTS

| | | | | |
|---|---|---|---|---|
| 3,011,450 | A | 12/1961 | Tyree, Jr. | |
| 3,023,710 | A | 3/1962 | Tyree, Jr. | |
| 3,263,622 | A | 8/1966 | Tyree, Jr. | |
| 3,277,797 | A | 10/1966 | Tyree, Jr. et al. | |
| 3,430,576 | A | 3/1969 | Tyree, Jr. | |
| 4,932,214 | A * | 6/1990 | Nieratscher et al. | 62/50.6 |
| 5,188,519 | A | 2/1993 | Spulgis | |
| 5,411,374 | A | 5/1995 | Gram | |
| 5,545,015 | A | 8/1996 | Scherrer | |
| 5,575,626 | A | 11/1996 | Brown et al. | |
| 5,593,288 | A | 1/1997 | Kikutani | |
| 5,787,940 | A | 8/1998 | Bonn et al. | |
| 5,860,798 | A | 1/1999 | Tschopp | |
| 5,884,488 | A | 3/1999 | Gram et al. | |
| 6,006,525 | A | 12/1999 | Tyree, Jr. | |
| 6,481,218 | B1 * | 11/2002 | Drelser | 62/50.6 |
| 2003/0051486 | A1 * | 3/2003 | Ursan et al. | 62/50.6 |

* cited by examiner

*Primary Examiner*—Charles G. Freay

(57) ABSTRACT

A high pressure pump and delivery system mating to LNG storage and suited for natural gas powered trucks and buses, but also suitable for other cryogenic liquid fuels. The reciprocating pump is comprised of a liquid pumping portion and a vapor compressing portion, operating in concert so that it is possible to locate the pump above a source of saturated LNG and to reliably supply high pressure LNG. The delivery system provides a method of utilizing both the pumped LNG and the compressed NG in a Diesel type fuel injection system, and also to scavenge NG vapor from the LNG storage container so as to extend it's storage life. While especially useful for trucks and buses, the present invention is not limited thereto, as it is also useful for locomotives, automobiles and other vehicles designed to operate through combustion of natural gas, as well as stationary applications.

27 Claims, 5 Drawing Sheets

SELF GENERATING LIFT CRYOGENIC PUMP FOR MOBILE LNG FUEL SUPPLY SYSTEM

CROSS REFERENCE TO RELATED APPLICATIONS

Not Applicable

STATEMENT OF FEDERALLY SPONSORED RESEARCH AND DEVELOPMENT

Not Applicable

SEQUENCE LISTING

Not Applicable

BACKGROUND

Field of the Invention

This invention relates to the apparatus and methods suitable for very low Net Positive Suction Head (NPSH) cryogenic (and other low temperature boiling liquids) pump systems, either mobile or stationary, able to operate under a wide variety of liquid supply conditions. These conditions include where the pump is above, at or below the source of liquid; whether pumping to low or medium or high pressures; start-stop against discharge pressure; and from zero to low to high NPSH at the pump's intake. Thus it can operate under conditions including where NPSH varies during use from none, to little, to much while pumping. One example of such zero NPSH difficult pumping applications is where the pump is located above a saturated or near saturated cryogenic liquid source carried in a small tank located on a vehicle (the vibration of the vehicle/motor tending to destroy any liquid stratification or pressure building result), thus providing near zero Net Positive Suction Head (NPSH) or less at the intake of the pump's inlet conduit, a condition under which most known cryogenic pumps cannot reliably operate, especially as the tank becomes nearly empty. Furthermore, for many reasons, it may not be desirable to vent to the atmosphere vapor from the cryogenic or liquefied gas storage system; accordingly many traditional methods/techniques utilized in the cryogenic pump industry incorporating pressure building or similar techniques to provide prime or NPSH to a pump are not appropriate. A still further problem is that many such cryogenic systems are self-refrigerating, depending upon the repetitive delivery of cold liquid cryogen to provide the system's refrigeration needs, thus such pressure building methods are undesirable, as they add heat to the system.

One specific application where all these pumping abilities would be desirable is when using LNG (liquefied natural gas) as an on-board fuel for large trucks or buses (or other large mobile powered units), using a LNG fueled engine. Typically the LNG must be delivered by a LNG tank truck or rail car from the producing point to a bulk dispensing station having a large LNG storage vessel; from which the LNG is transferred into each truck's on-board fuel tank. Low pressure fuel storage tanks are desired so as to minimize their weight and costs. Then, as the truck's engine requires fuel, the LNG is vaporized and supplied to the engine at a pre-determined pressure, with the desired pressure being a function of the engine's specific design. Some engines are designed to operate at pressures below about 200 psig while others above about 2,000 psig, and still others at an intermediate pressure. One special difficulty presented at a LNG bulk station is that it is frequently desired for safety reasons to locate the LNG storage vessel underground and thus it is very inconvenient to locate a transfer pump underneath it, as is normal practice with many cryogens when stored in aboveground vessels. Depending upon a number of individual operational factors (and vessel design), the LNG in the underground vessel can be sub-cooled and/or pressurized and the vessel nearly full, thus offering substantial NPSH to an above-ground pump (once primed); or the opposite—at equilibrium conditions and an almost empty vessel, thus offering no NPSH to an above-ground pump; and accordingly the pump is subject to a variety of constantly changing, but normal, operating conditions.

Almost similar type difficulties and conditions are presented on the LNG fueled truck itself in providing NG to the engine. The most favored location on the truck or bus for the on-board fuel (LNG) tank(s) is low, and it would be inconvenient and unsafe to position a pump below the tank in an attempt to provide NPSH to the pump. In addition, the almost constant movement of a truck or bus (and of consequence the LNG fuel tank) causes the LNG throughout the tank to be at near equilibrium conditions, again making the provision of NPSH difficult.

Furthermore, it is desirable to be able to utilize as fuel nearly all the LNG in the tank, thus the ability to pump from a near empty fuel tank is desirable. A special difficulty of cryogenic and liquefied gas systems is that it is desirable to conserve the refrigeration potential of the stored liquid to the greatest extent possible, so that no venting of the cryogen or liquefied gas occurs, either when fuel is being used or when the truck is at rest; accordingly any heat conductive connections to the pump should be such that the heat leak caused by the pump is minimized. A still further difficulty is the wide range of fuel (LNG) supply rates required by trucks or buses and thus pumping capabilities required as the vehicle's engine goes from no use to idle to mid speed and to high speed in highly variable sequences on an as-needed basis. Different engines have different desired supply/injection pressures, but one current desire is to favor injection at higher pressures because of increased efficiency and reduced pollutants in the engine's exhaust gas. While it is theoretically possible to inject the LNG into the engine while in the liquid state (as with diesel fuel), the problems of variable volumetric efficiency associated with cryogenic pumps and the variation in LNG's density associated with its saturation pressure have made this unfeasible. Accordingly, designers have favored vaporizing the LNG after pumping it to the desired pressure and then supplying/injecting the natural gas (NG) to the engine as compressed natural gas (CNG). This typically requires a vaporizer (using the atmosphere and/or waste engine heat or other heat source) for warming the now pressurized LNG thus forming CNG, which is then stored in a small pressure vessel maintained between two pressures, the lower pressure of which is the minimum supply/injection pressure and the upper pressure of which is determined by system capabilities or other factors and delivered through a pressure regulator at the desired pressure; all controlled by a device to monitor the pressures and cause the pump to operate.

The U.S. Dept. of Energy (DOE) in a Small Business Innovation Research Program Solicitation No. DOE/ER0686 identified "Liquid Natural Gas Storage for Heavy Vehicles" as a technical topic in which DOE has a R & D mission. In this Solicitation, on-board medium pressure (about 500 psig) and high pressure (about 3,000 psig) cryogenic pumps for LNG fueled vehicles were identified as specific areas where innovation was specifically desired. A related pump use is where it is desired to also be able to provide CNG or LNG at the bulk dispensing station for charging the truck's small pressure vessel or similar uses, thus a high pressure transfer pump is needed capable of pumping from a LNG source lower than itself (underground).

While LNG in mobile applications is used as an example herein, almost every cryogenic liquid being pumped from storage under conditions wherein a reduction in pressure below the liquid's equilibrium pressure or where the incursion of heat into the liquid, causes part of the intake liquid to vaporize would present similar difficulties. This includes cryogens which vaporize easily from heat incursion, and also liquefied gases, which while less sensitive to heat incursion, vaporize readily from a reduction in pressure.

These problems have generally been addressed by pumps characterized by the term "low NPSH" pumps. Included in previous low NPSH designs are U.S. Pat. No. 3,011,450 issued Dec. 5, 1961; U.S. Pat. No. 3,023,710 issued Mar. 6, 1962; U.S. Pat. No. 3,263,622 issued Aug. 2, 1966; U.S. Pat. No. 3,277,797 issued Oct. 11, 1966; and U.S. Pat. No. 6,006,525 issued Dec. 28, 1999—all to the present inventor. Also U.S. Pat. No. 5,188,519 issued Feb. 23, 1993 to I. S. Spulgis. In particular, these patents illustrate a type of reciprocating pumping mechanism where the intake valve is caused to open by the mechanical action of the piston rod retracting from a center opening in a hollow piston, a type of action commonly referred to as a "lost motion" action, as the piston does not move as far as does the piston rod. This mechanical opening of the intake valve reduces one principal need for NPSH, that of causing the intake valve to open by a reduction in pressure across it. In addition, if the intake valve is located above the compression chamber, vapor in the compression chamber can escape backwards by rising through the open intake valve. These designs require that the pumping chamber be located even with or lower than the source of liquid for optimum low NPSH service.

U.S. Pat. No. 5,411,374 issued May 2, 1999 to A. Gram represents a pump design able to be located above the supply container and able to pump saturated liquid from the container's bottom, a condition described by Gram as "negative feed pressure". The pump essentially has a double acting piston removing vapor in the pump's inlet conduit at a rate sufficiently fast that liquid rises into the pump; as Gram states "by removing vapor from liquid in an inlet conduit faster than the liquid therein can vaporize by absorbing heat. . . " However, absorbing heat is but one element in the source of vapor, as equilibrium liquid almost instantaneously releases vapor (and cools itself by evaporative cooling) as its pressure is reduced. In any event, the Gram pump is essentially a pump and/or compressor, handling intermittently under the different conditions that are encountered when pumping such liquids: all vapor, or vapor and liquid mixed, or all liquid. When handling all vapor it becomes a single stage compressor, with all the limitations—when compared to a single stage pump—of a single stage compressor, i.e.: greatly increased power; greatly increased heat generation (heat of compression); greatly reduced capacity; and greatly reduced possible pressure differentials. When handling vapor and liquid mixed (and at low NPSH or "negative feed pressure"), cavitation occurs and the pump's volumetric efficiency (and output) become unpredictably reduced, sometimes to the extent that vapor locking and pumping failure results, especially so when operating at compression ratios of about 10 or more.

U.S. Pat. No. 5,575,626 issued Nov. 19, 1996 to Brown et al is a pump submerged from the top into a container to the bottom. However, the mechanisms represent a serious and constant heat leak and the pump requires positive NPSH to open its spring loaded inlet valve.

U.S. Pat. No. 5,787,940 issued Aug. 4, 1998 to Bonn et al is a pump submerged from the top to the bottom of a separate sump attached to the storage vessel, so that the sump can be flooded with liquid when the pump is in use or not flooded when not in use, so as to reduce the heat leak when not operating. However, the heat gain to the system is substantial due to the heat leak to the sump and pump, even when not filled with liquid; and due to both the sump's and the pump's thermal masses, and the consequent warming of the liquid when it is desired to return the sump and pump to the proper operating temperatures.

U.S. Pat. No. 5,860,798 issued Jan. 19, 1999 to Tschopp is representative of a more common type of cryogenic pump having both spring loaded inlet and outlet valves. The pump is located below its supply container and two connections to the supply container allow liquid to flow down to the pump and vapor to flow back, due to gravity. However, this type of pump cannot pump from a liquid source that is lower than itself, and is not satisfactory at very low NPSH conditions.

U.S. Pat. No. 3,430,576 issued Mar. 4, 1969 to the present inventor is for a low NPSH liquefied gas (liquid carbon dioxide) pump having a spring loaded inlet valve, but creates a temporary increase in suction pressure (NPSH) at the inlet valve during the intake stroke, so as to temporarily provide sufficient NPSH to open the spring loaded inlet valve. Variations of this are also found in the '626, the '940, and the '798 patents. All require that the liquid be supplied to the pump.

U.S. Pat. No. 5,593,288 issued Jan. 14, 1997 to Kikutani is a liquefied gas pump shown in a mobile LNG application, top mounted and submerged to the bottom of the storage vessel; having a leakage path during the initial phase of the compression stroke back to the storage tank intended to allow vapor (bubbles in the liquid) to escape the compression chamber during the initial phase of the compression stroke, and thus avoid cavitation. However, the amount of vapor or bubbles can vary due to a number of factors, and thus excessive bubbles (and liquid) or insufficient bubbles can be allowed to escape, interfering with desirable pump operation.

A container for a cryogenic liquid that is stationary can be referred to as a vessel, and one that is mobile can be referred to as a tank, and tanks are considered to be smaller than vessels, but these terms can be used interchangeably.

The definition of a cryogenic liquid as used herein is one found in "Cryogenic Engineering" by R. B. Scott, Van Nostrand Co. 1959 which is that it is a liquid whose critical temperature is below terrestrial temperatures, taken as minus 70° F. Examples include nitrogen, oxygen, argon, methane, hydrogen and natural gas, when in the liquid condition.

The definition of a liquefied gas as used herein includes cryogens but also substances (gases) when stored under conditions where the gas is in the liquid phase and where the storage temperature is below the ambient conditions there/then present. It can be a saturated liquid if it is at both the saturation temperature and pressure; it can be a sub-cooled liquid if the temperature of the liquid is lower than the saturation temperature for the existing pressure; and can be a compressed liquid if the pressure is greater than the saturation pressure for the temperature it is at. Examples include carbon dioxide, ammonia, and other low temperature refrigerants.

BRIEF SUMMARY OF THE INVENTION

The present invention provides a system and method for reliably pumping cryogenic liquids to low, medium or high pressures when the pump is located even with, above or remote from, its source of liquid and the liquid may or may not be saturated. The low NPSH pumping system and method of the present invention provide the suction lift required to bring a saturated liquid (but also less demanding condition liquid) to the pump, and are equally capable of pumping under zero, very low, medium or high NPSH conditions or conditions where the NPSH varies during pumping. The system and method also are able to remove any vapor created by the pumping action, thereby preventing vapor locking or damaging cavitation of the pump. The system and method also offers a number of desirable options for utilizing the removed vapor. As such, they provide the unique versatility necessary to meet the varying conditions encountered in many pumping applications. Depending upon the needs of the entire system the pump is part of, the vapor can be returned to the source container, either below or above the liquid level in that container, or supplied to a vapor using need external to the tank or vessel (such as NG to an engine or other need).

One key element of this system is recognition that the amount of vapor encountered when bringing such liquids to the pump and filling the compression chamber of the pump with a cryogenic liquid or liquefied gas can vary greatly (either increase or decrease). This variation can result from a number of causes, even while pumping, as they are a function of many factors, some of which are: condition or available NPSH of the inlet liquid resulting from storage or flow characteristics of the inlet conduit or other reason, and incoming liquid vaporizing upon contact with warmed pumping chamber elements, the result of frictions. Another factor is residual liquid in the clearance volume expanding to vapor upon the depressurization accompanying the suction stroke as a result of the heat of compression (greater at higher discharge pressures), all resulting in vapor in the inlet side of the pump, which needs to be removed in order to effect reliable high pressure pumping of saturated cryogenic liquids.

Another key element is purposeful vapor removal from a saturated cryogen or liquefied gas located within the inlet conduit of a pump so as to provide suction lift, by causing the remaining cryogen or liquefied gas in the conduit to be cooled by evaporative cooling, thereby providing the differential pressure required for the suction liquid lift for a pump located above, alongside or remote from, the liquid source; and to essentially empty the liquid source. This process is progressive as the liquid in the inlet conduit continues to rise, and also is progressive as new liquid enters the inlet conduit. The cooled cryogen or liquefied gas can continue to be cooled and provided with lift so long as vapor is removed and the resultant evaporative cooling occurs faster than any warming of the evaporative cooled liquid in the conduit. The volume increase occurring when many of these liquids become gas is typically greater than about 40 to 1 under normal storage conditions, so a relatively small volume of liquid becoming vapor can result in a great volume of vapor. While it varies some for each liquid and storage conditions, a lift of over about 10 ft. for some saturated cryogens can result in a greater volume of vapor than liquid.

Accordingly, a pump system is provided that is able to satisfactory function under a wide variety of conditions; instead of the opposite situation, where the conditions must be correct for the pump to operate properly. This eliminates many special conditions and limitations faced in the past at pump installations for the cryogenic liquids and liquefied gases, especially the lower temperature cryogenic liquids. In addition, the dual compressing/pumping nature of this pump uniquely satisfies the requirements of mobile LNG fuel supply for dual injection pressure Diesel type engines and also has the capability to extend the storage life of the on-board LNG storage.

It should be understood that while the invention is described as especially useful for certain LNG applications, there are many other pumping applications involving LNG and other cryogenic liquids or liquefied gases where the dual path arrangement for supplying and pumping liquid and removing vapor from the intake side of the pump and the intake liquid container and other elements of the invention would find valuable use.

BRIEF DESCRIPTION OF SEVERAL VIEWS OF THE DRAWINGS

FIGS. 2A, 2B and 2C are simplified diagrammatic/sectional views of the pump of FIGS. 1A, 1B, 1C and 1D installed above the source of liquid, as at a bulk LNG station (where the bulk LNG storage tank may be below ground level), and illustrating the various locations the compressed vapor may be supplied to.

Figure 1A:
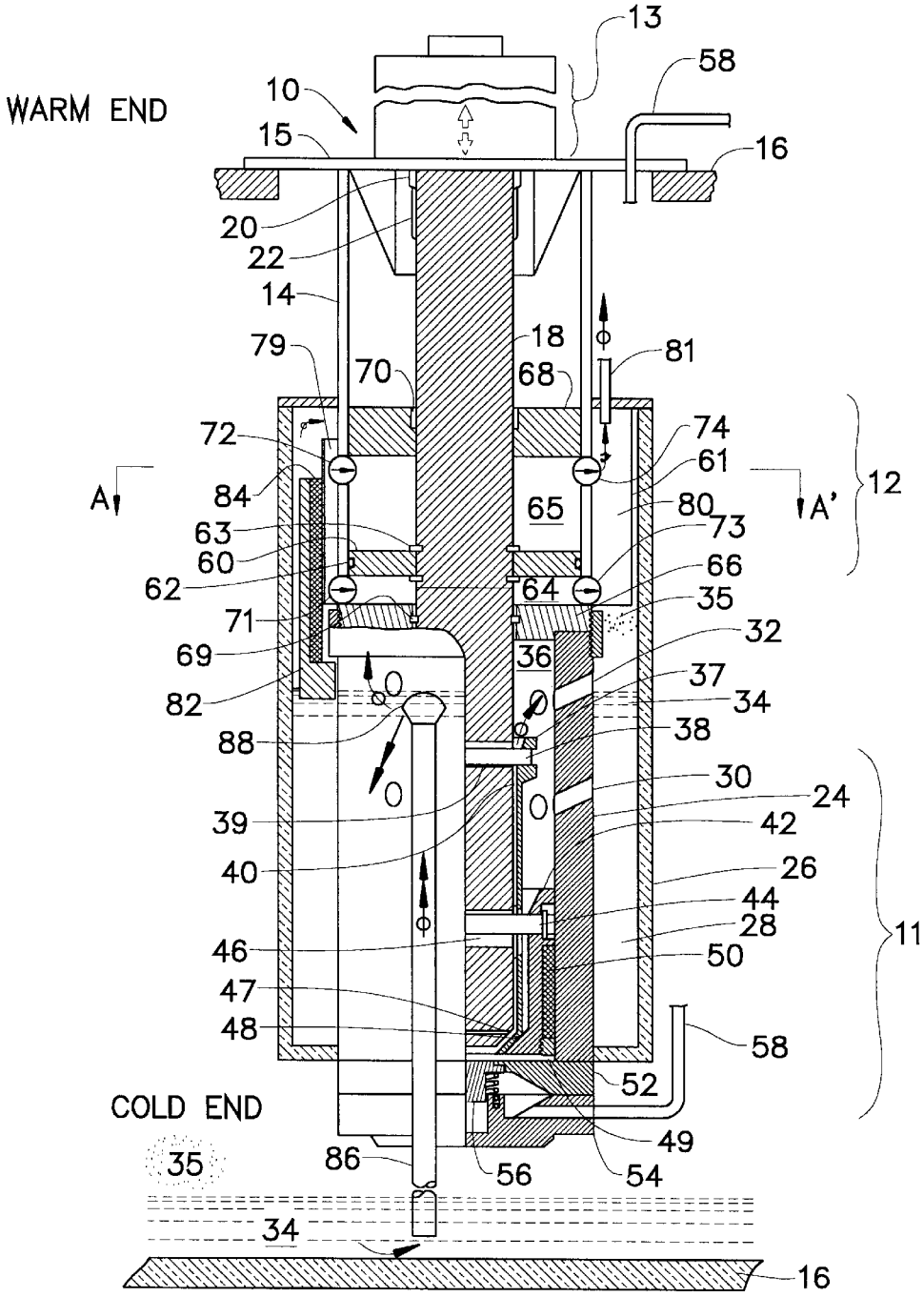
FIGS. 1A, 1B, 1C and 1D are simplified diagrammatic/sectional views of the invention incorporating both a low, medium or high pressure, lost motion type reciprocating piston pump and a gas/vapor compressor arranged to remove any vapor occurring at the pump's inlet area and to return any compressed vapor to the source liquid container, or to a use outside the container.

In the drawings that follow, an arrow ⟶ represents a cryogenic liquid (or liquefied gas), an arrow with a circle following the head ⊖► represents the vapor phase of the cryogenic liquid, a double headed arrow ⟶► represents a cooled cryogenic liquid, a double headed arrow with a circle following the heads ⊖►► represents a mixture of vapor and the liquid it cooled, a triple headed arrow ⟶►► represents a compressed liquid and a triple headed arrow with a circle following the heads ⊖►►► represents a compressed vapor.

DETAILED DESCRIPTION OF THE INVENTION

Shown in FIGS. 1A, 1B, 1C and 1D is the pump of the present invention 10; having a cryogenic pumping portion 11 of the reciprocating mechanically opened intake valve/lost motion type (depicted as a double lost motion type), also incorporating a separate vapor removal compressing portion 12 connected to the intake side of pumping portion 11, and a drive portion 13, all making it possible to pump to high pressures near equilibrium or saturated condition cryogenic liquids or liquefied gases from a source lower than the pump, and also useful for any other liquid conditions and pump or storage locations. The embodiment of the present invention illustrated in FIGS. 1A and 1B incorporates as pumping portion 11 a pump of the type described in U.S. Pat. No. 6,006,525 to the present inventor.

As best shown on FIG. 1A, pump 10 is comprised of cylindrical casing 14, mounted at one end to a warm end plate 15, as could be installed on a typical insulated cryogenic liquid storage tank 16 (or vessel 16'), on which the reciprocating drive and drive controls 13 are mounted. The single acting pumping portion 11 is just past the beginning of the its suction stroke, and the double acting vapor removal compressing portion 12 is both just past the beginning of a suction stroke and just past the beginning of a discharge stroke. While various drive arrangements can be used with the invention, the depicted drive 13 is a typical reciprocating hydraulic type. Drive 13 is arranged to transmit its reciprocating motion to a piston rod 18. Suitably mounted near plate 15 and between the inside of casing 14 and rod 18 are warm end packing 20 and warm end guide bushing 22. At the opposite end of casing 14, pumping cylinder housing 24 is so connected and contained within lower casing 26, so as to form sump 28. Liquid inlet ports 30 and vapor outlet ports 32 provide openings in cylinder 24 for flow of cryogenic liquid 34, and its vapor phase 35 occupying the space above the liquid phase 34, with ports 30 and ports 32 acting as conduits between sump 28 and pump intake chamber 36. Cryogenic liquid 34 is depicted at the bottom of vessel 16, in sump 28 and in chamber 36, with it's vapor 35 above, with appropriate arrows indicating liquid and vapor flows as pump 10 operates. Pump 10 is generally mounted either vertically or inclined, with the warm end higher than the cold end, so that liquid 34 readily tends to flow from sump 28 down through ports 30 into chamber 36 and vapor 35 readily tends to flow up through ports 32 from chamber 36 into sump 28, all due to gravity, once sump 28 contains liquid 34 to a level at least between ports 30 and 32.

Figure 1B:
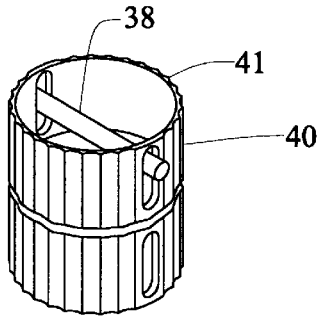

A first cylindrical and hollow pumping piston 37 loosely fits over the cold end of rod 18, so as to form a conduit between the outside of rod 18 and the inside of piston 37. Pin 38 which is secured to piston 37 slidably engages and passes through slot 39 of rod 18. Bushing 40 is fastened to rod 18 so as to loosely guide piston 37, and contains serrations 41 as illustrated in FIG. 1B so as to not impeded flow of vapor 35 or liquid 34 through the conduit between rod 18 and piston 37.

A second cylindrical and hollow pumping piston 42 fits loosely over piston 37 so as to form a conduit between the outside of piston 37 and the inside of piston 42. Pin 44, secured to piston 42 and slidably positioned in slots formed in piston 37 and bushing 40, engages slot 46 of rod 18. The cold end nose of rod 18 is tapered so as, when portion 11 is on it's compression stroke, it forms a seal with the also tapered inner nose section of piston 37 by compressing nose end seal 47. The cold end outer nose of first piston 37 is similarly tapered so as, when pumping portion 11 is on it's compression stroke, it forms a seal by compressing nose end seal 48 with the tapered inner nose of piston 42. These actions form the opening and closing of pumping portion 11's intake valve mechanisms.

As the depicted liquid intake stroke begins, slot 39 and slot 46 are arranged so that pin 38 is engaged by slot 39 before pin 44 is engaged by slot 46. Accordingly, the initial portion of the intake valve action to open is that located at seal 47. This allows any vapor 35 in the pumping chamber 49 to escape by a dedicated path back to sump 28 before the principal liquid intake action begins through a separate path. Once pin 38 engages the bottom of slot 39, rod 18 and piston 37 move simultaneously. This action causes piston 37 to rise with respect to piston 42, so the next intake valve action to open is that located at seal 48, Once both intake valve actions have occurred and pin 44 has engaged the bottom of slot 46, piston 37 and piston 42 move as one unit through the remainder of the suction stroke. Liquid cryogen 34 then freely flows between pistons 37 and 42 and into chamber 49, essentially unimpeded by vapor 35 egressing chamber 49 between piston 37 and rod 18. As influenced by rod 18, pins 38 and 44, pistons 37 and 42 then move simultaneously to Top Dead Center, where the suction stroke ends and the compression stroke begins.

After Top Dead Center is passed, both intake valve mechanisms close in sequence, the first to close that formed by the tapered end of rod 18 and the tapered inner nose section of piston 37, and then the second to close that formed by the tapered nose end of piston 37 and the tapered inner nose section of piston 42, and then actual compression of liquid 34 and any attendant vapor 35 occurs in chamber 49. Pumping chamber 49 is sealed along the exterior of piston 42 by combination bushing and high pressure sliding seals 50. Upper discharge end plate 52 and lower discharge end plate 54 close chamber 49 and contain discharge check valve 56. As rod 18, pistons 37 and 42 then move simultaneously in the compressing stroke, pressurized liquid 34 flows through valve 56 and through discharge line 58, which exits pump 10 through plate 15, to use.

Figure 1C:
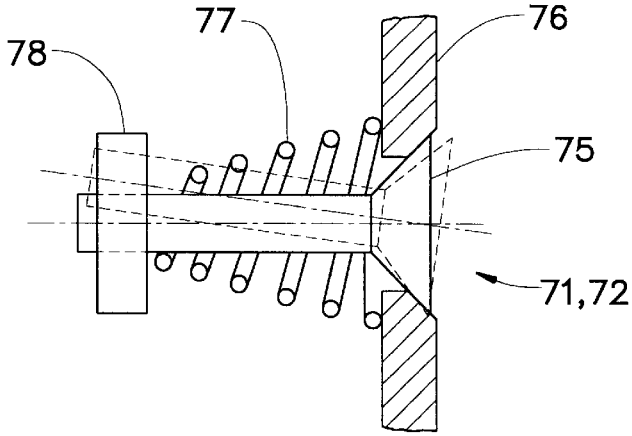

Vapor removal compressing portion 12 of pump 10 is comprised of a vapor removal piston 60, which is slidably positioned within vapor removal housing 61. Piston 60 features sliding seals 62 and is attached to rod 18 on both sides by retainer rings 63, so that it, like the pumping portion 11, also reciprocates in response to the action of drive 13; in one direction both a suction stroke for causing vapor to enter lower chamber 64, and a compression stroke for discharging any vapor in upper chamber 65 (as depicted) and the reverse when moving in the other direction. Pump chamber 36 is separated from chamber 64 by lower chamber plate 66 and upper chamber plate 68 separates chamber 65 from the warm end of pump 10. Lower chamber seals 69 are located in plate 66 and upper chamber seals 70 are located in plate 68. Compression of vapor 35 by portion 12 occurs as controlled by lower suction check valve 71 and upper suction check valve 72 and lower discharge check valve 73 and upper discharge check valve 74, all mounted to housing 61. FIG. 1C depicts valves 71 and 72, with clack 75 held against seat 76 by the action of spring 77 against retainer 78. Retainer 78 is made of a material that is attracted by a magnet, and if retainer 78 is attracted sidewise by a magnet, clack 75 is held in a cocked position and is not able to close, thereby disabling (unloading) the compressing action of the chamber it serves (as depicted by the alternate center line). Other methods of unloading compressing portion 12 are well known in the compressor industry and can be substituted without departing from the present invention.

Figure 1D:
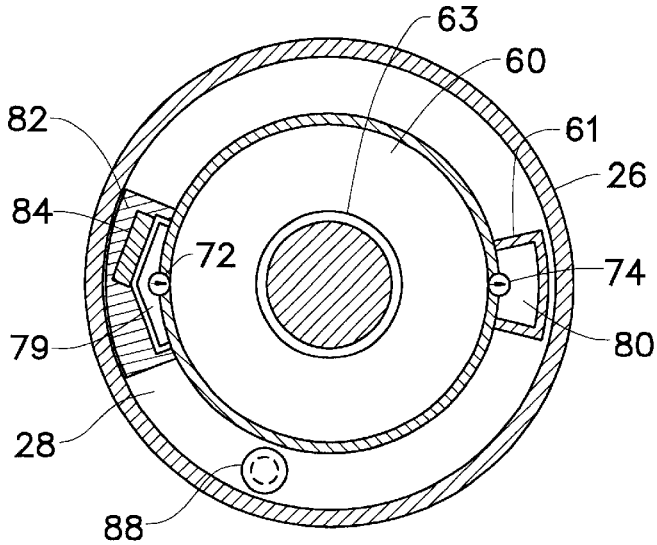

FIG. 1D is a simplified view along line A–A' of FIG. 1A, showing the control elements and valves of vapor removal portion 12 of pump 10; at a time when sufficient liquid 34 is in sump 28, but some vapor 35 is being released from chamber 49. Valve 72 communicates with suction cavity 79, which communicates with sump 28. Valve 74 communicates with discharge cavity 80 and discharge vapor line 81 in turn. Accordingly, valve 72 communicates with the upper portion of sump 28, containing float type level control 82, which is equipped with magnet 84 that as control 82 rises, magnet 84 also rises and attracts suction valve 72 so that it is held open in the manner illustrated in FIG. 1C, by the magnetic action of control 82. Magnet 84 is located so as to progressively disable the action of compressing portion 12 by disabling in turn, valve 71 and valve 72, and thus compensate for the varying amounts of vapor 35 created in pumping portion 11 or arriving at sump 28 through seperator 88, possibly from all vapor during pumping portion 11's cool-down to no vapor when tank 16 (or vessel 16') are full, or when there is NPSH available. If control 82 then rises to where the point that magnet 84 has attracted valve 71 so that it is cocked and remains open (disabled), but not valve 72, thereby causing partial unloading of compressing portion 12. If control 82 continues to rise, valve 72 is also attracted by magnet 84 so as to remain open, and no vapor 35 is removed from sump 28. This condition results in compressing portion 12 becoming vapor trapped, so that no liquid 34 reaches valve 71 and valve 72. If control 82 sinks, magnet 84 allows both valve 71 and valve 72 to function normally, and vapor 35 to be removed from sump 28 at the full capacity of compressing portion 12. If desired, magnet 84 can be separated into two halves and each half so located in control 82 that the order in which valve 71 and valve 72 become disabled is reversed (not shown); or alternately valve 71 and valve 72 become disabled simultaneously (not shown). Other type known level controls can be substituted without departing from the present invention.

Figure 2C:
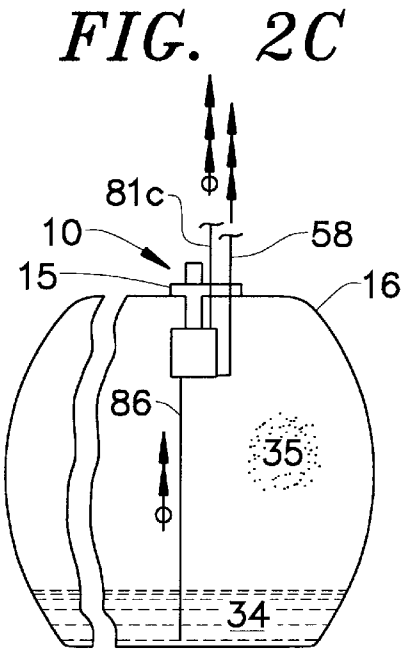
Figure 2B:
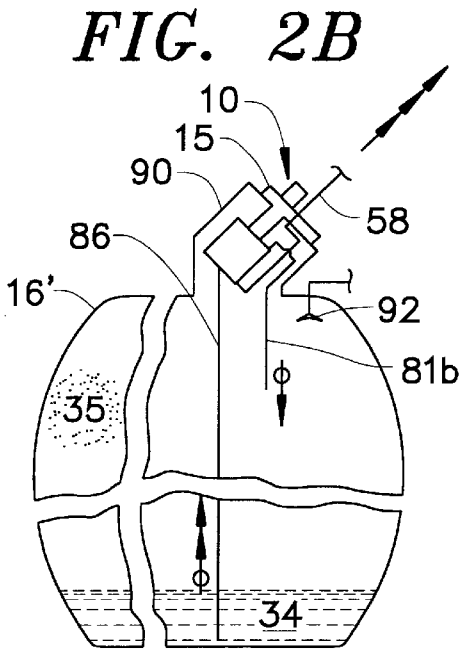
Figure 2A:
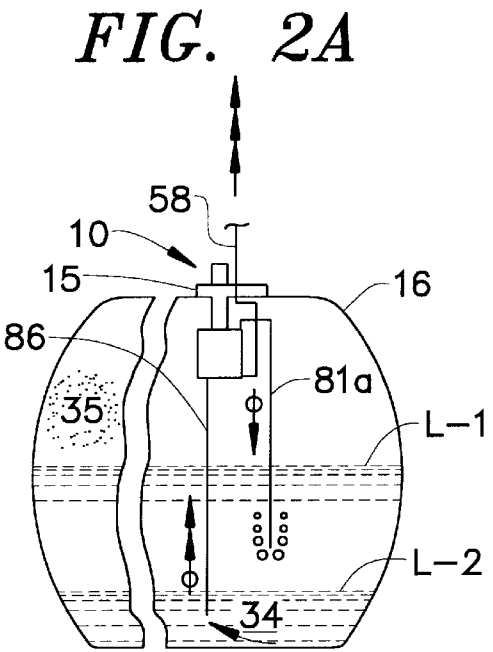

As shown in FIGS. 2A, 2B and 2C, discharge vapor line 81 can be extended, line 81*a* or line 81*b* or line 81*c*, so as to direct any compressed vapor 35 to where it is most useful, depending upon the supply and use circumstances of the entire facility pump 10 is a part of.

FIG. 2A shows pump 10 as located above storage tank 16 (or vessel 16'), wherein pump 10 is inserted into tank 16 (or vessel 16') through an opening in it's top, utilising plate 15 for mounting. A tank generally refers to a liquid container that in some fashion is (or can be) mobile, and vessel to a liquid container that is stationary. Line 58 takes the compressed liquid 34 to use (not shown). Inlet line 86 extends to near the bottom of tank 16 (or vessel 16'), so tank 16 (or vessel 16') may be nearly emptied by pump 10, and vapor return line 81*a* extends not quite as far as does line 86, so that the returning vapor 35 does not unduly agitate the stored liquid 34 or dissipate any NPSH at the inlet of line 86. When tank 16 (or vessel 16') contains liquid 34 to a level above L-2, such as L-1, vapor 35 returning tends to be cooled as it bubbles up through liquid 34 so as to return to the vapor space in tank 16 (or vessel 16'). This action both reduces the volume of vapor 35 and warms liquid 34 as it bubbles through, as well as reducing any temperature related stratification of liquid 34 and consequent high pressure in tank 16 (or vessel 16'). Moreover, this warming of liquid 34 extends the fill life of tank 16 (or vessel 16'), as much of the heat gain of pump 10 and tank 16 (or vessel 16') then tends to be removed with the pumped liquid 34. When the level of liquid 34 falls to level L-2, such action would no longer occur. Pump 10 and tank 16 (or vessel 16') are not shown to the same scale, as if tank 16 (or vessel 16') is large, pump 10 benefits by being located in the ullage volume of tank 16 (or vessel 16'), thereby tending to remain cold during non-use, and not imposing as large a heat leak to the system. A small extension on the top of tank 16 (or vessel 16') could be provided to accept pump 10 (not shown).

Turning next to FIG. 2B, typically used for larger vessels 16', where it is frequently desired to mount a pump external to the vessel, pump 10 is connected in such a manner that pump 10 may be disconnected from vessel 16' without depressurizing vessel 16', even through liquid 34 may be in it. In this case, pump 10 can be mounted inclined (or vertical if preferred) inside an insulated enclosure 90, and vapor line 81*b* may only extend partially below the safe fill line for vessel 16'. Line 58 takes the compressed liquid 34 to use (not shown). A spray header 92 is typically used during liquid replenishment, condensing vapor 35 with the cold, low pressure liquid 34 typically being supplied, so as to reduce the pressure of vessel 16'and thus prevent venting of vapor 35. If desired, pump 10 could be remote from vessel 16', including inlet line 86 being external to vessel 16' and containing trap(s) (not shown).

Turning next to FIG. 2C, pump 10 is depicted as in FIG. 2A, except it is supplying both compressed vapor 35 with line 81*c*, and pumped liquid 34 with line 58, either to one use or to two uses, outside tank 16 or vessel 16'.

As can be seen from FIGS. 2A, 2B and 2C, the amount of lift, that is the distance from the point in tank 16 or vessel 16' where the actual inlet of the line 86 occurs to the liquid level desired within sump 28 can vary with the dimensions of tank 16 or vessel 16', as well as the method chosen to mount pump 10 to tank 16 or vessel 16'. For the same condition saturated or near saturated liquid, the greater this lift distance, the greater the capacity of compressing portion 12 of pump 10 should be. This occurs because the greater the lift, the higher the percentage of vapor formed in lifting saturated liquid by causing a reduced pressure, so as to produce the needed lift. Also, vapor is formed in the pump itself as caused by heat leak from pump 10's surroundings and from residual heat caused by friction and from residual heats of compression, or other reasons. Thus the higher the discharge pressure of pumping portion 11 and to a lesser degree compressing portion 12, the greater the quantity of vapor 35 formed. To accommodate such higher lifts and higher pressures, resulting in greater amounts of vapor 35 that is to be removed, the capacity of compressing portion 12 can be increased by increasing the diameters of chamber 64 and chamber 65, piston 60 and casing 14, and casing 26 to match. Vapor 35 returned to tank 16 or vessel 16' by compressing portion 12 can be returned to about the top, about the middle, or about the bottom of tank 16 or vessel 16' by line 81*a* or 81*b*, as individual circumstances dictate as to any desired point of return inside tank 16 or vessel 16' or outside tank 16 or vessel 16' by line 81*c* to various uses (not shown). A foot valve (not shown) can be used with line 86, if the dimensions and flow dynamics require such, so as to prevent back-flow of liquid 34 in line 86 when pump 10 is operating.

Figure 3A:
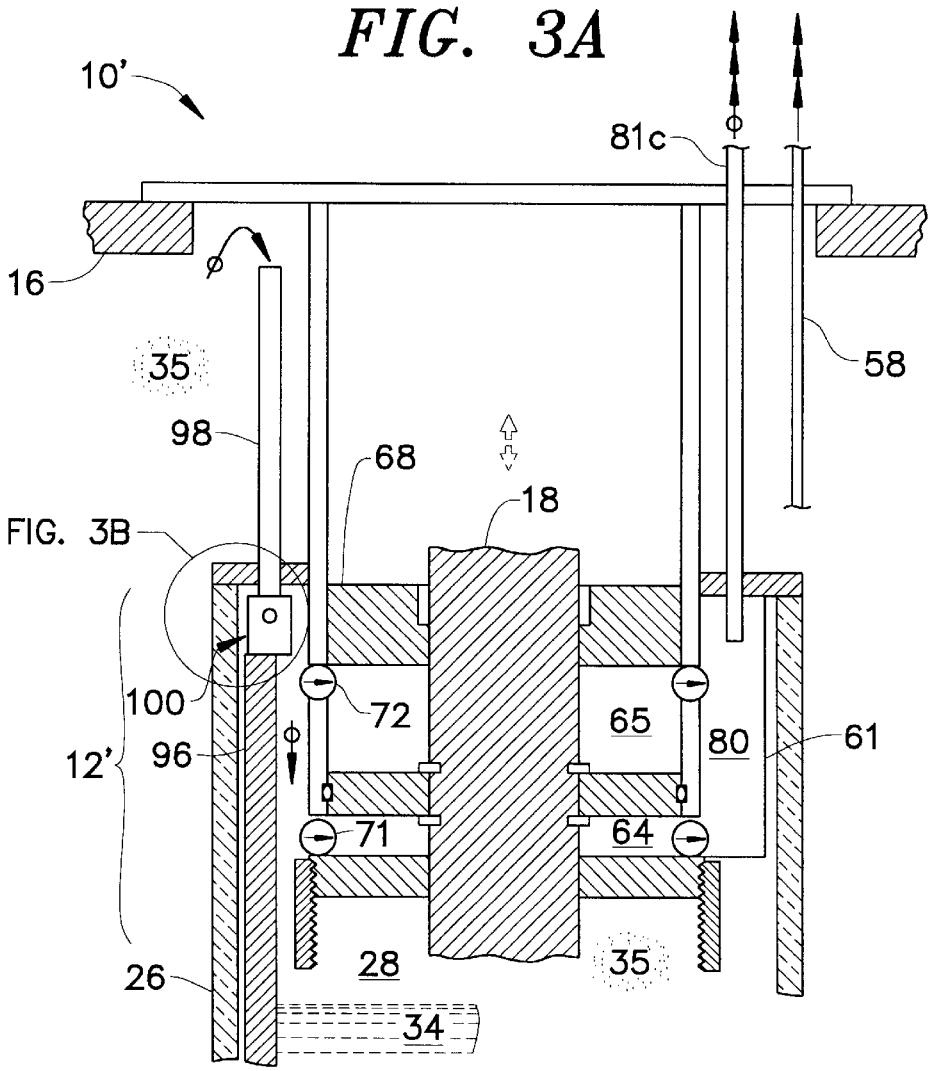
FIGS. 3A and 3B are a diagrammatic/sectional partial views of the pump of FIGS. 1A, 1B, 1C and 1D; but modified so as to be able to remove vapor from the ullage volume of the source liquid container, as well as that occurring at the pump's inlet area and also able to supply the compressed vapor to a use outside the source liquid container.
Figure 3B:
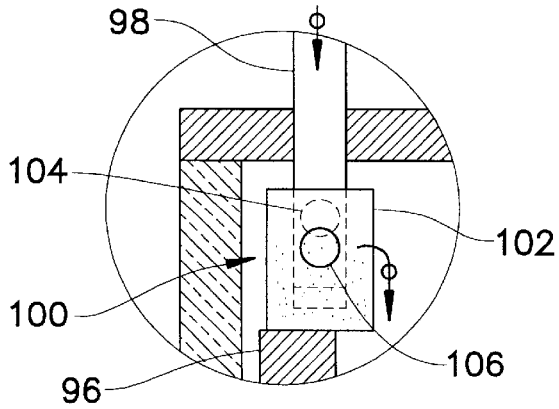

FIGS. 3A and 3B are simplified views of an alternate compressing portion 12' of pump 10', having an arrangement whereby vapor 35 is removed first from the sump 28 and then once sufficient vapor 35 has been removed from sump 28, removes vapor 35 from the ullage volume of tank 16 (or vessel 16'), and the compressed vapor 35 is supplied to a use outside tank 16 (or vessel 16'), along with the pumped liquid 34, with the discharge arrangements as depicted in FIG. 2C. The removal of vapor 35 from the ullage volume of tank 16 or vessel 16' has the desirable effect of extending the fill life of tank 16 or vessel 16'.

FIG. 3A depicts alternate float type liquid level control 96 arranged so as to change the source of vapor 35 supplying compressing portion 12' from the top of sump 28 to the ullage volume of tank 16 (or vessel 16'), utilizing line 98 and valve 100, which modulates the opening of line 98 in response to control 96, so that whenever liquid 34 in sump 28 is at the desired level, compressing portion 12' then removes vapor 35 from the ullage volume of tank 16 (or vessel 16'). Thus once the desired level of liquid 34 is present in sump 28, the action of control 96 provides a conduit between the ullage volume of tank 16 or vessel 16', and modulates the flow of vapor 35 through line 98 in response to the level of liquid 34 in sump 28 as sensed by control 96, so as to provide sufficient vapor 35 to removal portion 12'. Should it be desired (not shown), a valve can be installed in line 98 so that flow of vapor from the ullage volume of tank 16 or vessel 16' can be blocked and the functions of control 82 and control 96 combined so that valve 71 and valve 72 are disabled by the same means as described in FIGS. 1A, 1C and 1D in the event the flow of vapor 35 through line 98 is caused to cease.

FIG. 3B depicts valve 100 which modulates the size of the passageway in line 98 between sump 28 and the ullage volume of tank 16 (or vessel 16'). Sleeve 102 cooperates with control 96, and is slidably attached to line 98. Opening 104 in line 98 is closed by sleeve 102, unless control 96 has risen, and caused sleeve 102 to also rise, to the extent that opening 106 in sleeve 102 is aligned with opening 104, thereby allowing vapor 35 to flow through line 98 from the ullage volume of tank 16 (or vessel 16') to sump 28.

Figure 4A:
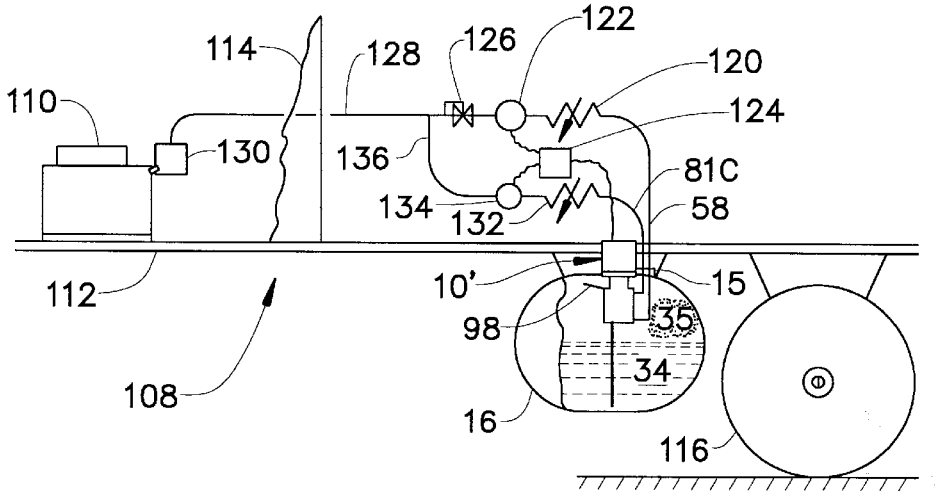
FIGS. 4A and 4B are simplified diagrammatic/sectional views of pump, modified in accordance with FIGS. 3A and 3B, installed on a truck or bus (not shown) using LNG as a source for fuel, with the pump above or alongside the on-board LNG tank and the compressed vapor from the pump being supplied to an LNG fueled engine, along with the vaporized/pumped liquid for supplying NG either at a single or at dual pressures for supply to or injection into the truck or bus engine.
Figure 4B:
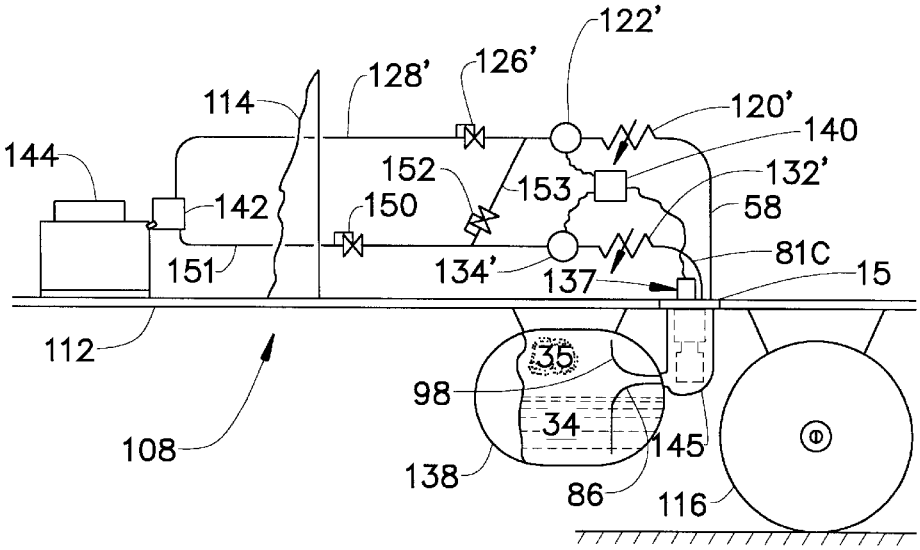

Turning next to FIGS. 4A and 4B, of special use when pump 10' is utilized to supply the cryogen (LNG) as a gaseous fuel (NG) to engine 110 of truck 108. The compressed vapor 35 and pressurized liquid 34 are warmed to about ambient temperature, either with waste heat from engine 110 or from ambient, then supplied to engine 110 of truck 108 as NG fuel. Tank 16 is shown mounted in saddle tank fashion from frame 112 to tractor type truck 108, and between cab 114 and tire 116.

FIG. 4A is a generalized view which depicts a case where engine 110 does not require NG fuel supplied at a pressure higher than about 500 psig. Pump 10' is located above and mounted to tank 16 in a manner similar to that shown in FIG. 2C, with lines 58 and 81*c* exiting tank 16 through plate 15. Pump 10' is modified in accordance with FIGS. 3A and 3B and alternate control 96, making it possible to also scavenge vapor 35 from the ullage volume of tank 16 through line 98. After exiting tank 16, lines 58 and 81*c* can be combined (not shown) or routed separately to vaporizers and use in engine 110 of truck 108. In this case, fuel (NG) supply pressure required by engine 110 is less than about 500 psig, a pressure that compressing portion 12' can readily provide if the pressure in tank 16 is above 50 psig, a normal condition. Accordingly, line 58 carrying pumped liquid 34 passes through vaporizer 120 to NG storage 122, whose pressure is monitored by control 124, which causes pump 10' to operate when the pressure in storage 122 is below a pressure of about 750 psig and causes pump 10' to cease operation when the storage pressure reaches a higher figure (about 1,000 psig), indicating engine 110 is requiring NG fuel at a slower rate than pump 10' is supplying it. Pressure regulator 126 maintains line 128 at the desired supply pressure to engine fuel control 130, which then supplies the NG fuel to engine 110. Line 81*c* carrying compressed vapor 35 passes through vaporizer 132 to storage 134, whose pressure is also monitored by control 124 and causes pump 10' to cease operation if the pressure becomes excessive or will cause line 98 to close. Storage 134 utilizing line 136 by itself provides fuel (NG) to line 128 until the pressure in line 128 drops below the setting of pressure regulator 126. When this ocurs, pressure regulator 126 opens so that NG fuel from storage 122 supplements the NG from storage 134 50 that the pressure in line 128 returns to the proper level. NG will be supplied to fuel control 130 through line 128 from both storage 134 and storage 122 until the pressure within storage 122 drops below approximately 750 psig. At that time, pump 10' will be caused to operate so as to replenish both storage 134 and storage 122. Storage 134 then returns to being the sole source of NG for line 128 after regulator 126 closes. Line 136 connects storage 134 with line 128, so both the compressed vapor 35 and the pumped liquid 34 supply the fuel needs of engine 110. Alternately, pump 10' could be mounted to tank 16 in the manner illustrated in FIG. 2B. FIG. 4B depicts a specific application utilizing pressurized and vaporized LNG as an on-vehicle fuel, wherein the unique capabilities of the present invention are displayed. Pump 137, tank 138, pressure control 140, fuel injection control 142 and engine 144, are installed on a large heavy duty truck or tractor truck 108 or intra-city bus (not shown) making multiple stops in a large, densely populated metropolitan area, using expressways for a portion of its run, such as the grater Los Angeles area. Pump 137 is as described in FIGS. 3A and 3B; having the ability to both pump liquid 34 to high pressure from tank 138 and when desired, to scavenge vapor 35 from the ullage volume of tank 138 so as to provide extended hold time for the LNG therein, without requiring a very high pressure capability for tank 138. Management of the internal pressure of tank 138 and of the supply pressures to engine 144 is by system gas (NG) storage and control 140; which can change the speed of pump 137 (if drive portion 13 is so equipped), or stop or stop pump 137; block line 98, open line 81*a* or 81*b* (not shown), and store a small amount of NG in gas storage at a suitable pressure for instant use as fuel in engine 144. For the purposes of this example, engine 144 is Diesel cycle, fuel injected requiring about 3,000 psig NG when the engine is under heavy load and about 500 psig NG when under light load or idling; and the response to the operator's input is to be immediate. Pump 137 can be mounted to tank 16 in a similar manner to that depicted in FIG. 4A; but for space convenience and thermal isolation, is located alongside tank 138, utilizing a head end opening in tank 138 for connecting insulated sump 145 into the top of which pump 137 is inserted. Pump 137 is modified in accordance with FIG. 3A and FIG. 3B. After exiting sump 145, line 58 carrying liquid 34 pumped to a high pressure, passes through vaporizer 120' to NG storage 122', whose pressure is monitored by control 140, which causes pump 137 to operate when the pressure in storage 122' is below about 110% of the minimum selected high injection pressure (about 3,300 psig) and causes pump 137 to cease operation when the pressure in storage 122' reaches a pressure about 120% higher than the selected minimum high injection pressure (about 3,600 psig), indicating engine 144 is requiring fuel at a slower rate than pump 137 is supplying. Pressure regulator 126' maintains line 128' at the selected high injection pressure to engine fuel control 142, which then supplies the high pressure NG fuel for injection into Diesel engine 144 when required. Line 81*c* carrying compressed vapor 35 passes through vaporizer 132' to storage 134', whose pressure is also monitored by by control 140. Regulator 150 maintains line 151 at the selected low injection pressure, supplying control 142. In the event that a greater quantity of low pressure NG fuel is required than that available in storage 134', regulator 152, located in line 153, supplies low pressure NG fuel from storage 122', should the supply of NG from storage 134' be insufficient.

A gas intensifier, which uses a higher pressure stream to raise the pressure of a lower pressure stream, and then joins it, can be added in either line 136 between storage 134 and line 128, with high pressure gas supply from storage 122

(FIG. 4A) should a higher pressure compressed NG be desired than pump 10' provides (not shown). Similarly, an intensifier can be added in line 151 between storage 134' and the junction of line 153, with high pressure gas supply from storage 122' (FIG. 4B), should a higher pressure compressed NG be desired than pump 137 provides (not shown).

Single lost motion pumps, such as U.S. Pat. Nos. 3,023,710 and 3,263,622 to the present inventor, have similar characteristics to the depicted double lost motion pump except there is only one piston. A number of low NPSH reciprocating piston pumps are available which provide assistance in opening the intake valve by inertia of the intake valve or momentary creation of a higher pressure regime at the entrance to the intake valve or by magnetic force or by a combination of these. Such pumps are able to reliably pump low NPSH, or very low NPSH cryogenic liquids as long as the pump's intake is covered with liquid and any vapor there is able to escape; and for the purposes of this invention, are all considered as benefiting the same as the depicted double lost motion pump.

Cryogenic liquids and liquefied gases are characterized by being typically stored under pressure above atmospheric. Some, (the cryogens) are manufactured at pressures only slightly above atmospheric, but are allowed to increase in pressure (by warming) in steps as the cryogen progresses along the distribution and use chain. Accordingly, pump 10, 10' or 137 can be operating at a varying number of intake pressures, as the pressure in sump 28 relates to the pressure of the liquid in tank 16, vessel 16' or tank 138.

Although the invention has been described with regard to what is believed to be the preferred embodiment, changes and modifications as would be obvious to one having ordinary skill in both pump design, cryogenic and liquefied gas engineering and compressed gas use can be made to the invention without departing from its scope. Particular features are emphasized in the claims that follows. The term conduit in the following claims should be interpreted broadly to include pipe, tube, valve and other devices used in the transfer of liquid or vapor.

What is claimed is:

1. A pump for a cryogenic liquid comprising:

a. a casing defining a sump having an inlet for containing a supply of the cryogenic liquid with a head space above;

b. a pumping cylinder housing postioned in said sump and defining a pumping cylinder having an inlet for communication with the supply of cryogenic liquid and an outlet;

c. a pumping piston slidably disposed within said pumping cylinder;

d. a rod connected to said pumping piston;

e. a vapor removal compressor including:

i. a vapor removal housing positioned above said sump and defining a vapor removal chamber having an inlet for communication with said head space and an outlet;

ii) a vapor removal piston slidably disposed within said vapor removal chamber;

iii) a suction valve in said vapor removal housing inlet;

iv) a discharge valve in said vapor removal housing outlet;

v) a level control positioned with respect to said sump for determining the level of a cryogenic liquid therein; and f. means responsive to said level control for disabling the vapor removal compressor whereby vapor is not removed from said sump.

2. The pump of claim 1 wherein said vapor removal piston divides said vapor removal chamber into an upper and lower chamber, each having a suction valve and an intake valve.

3. The pump of claim 1 wherein said level control is a float control positioned within said sump so as to float in any cryogenic liquid there, said float control having a magnet mounted thereto, and said magnet to disable said suction valve when said magnet is positioned near said suction valve.

4. The pump of claim 1 wherein said inlet of said sump includes an inlet conduit.

5. The pump of claim 4 further comprising a vapor liquid separator positioned within said sump and in communication with said inlet conduit.

6. The pump of claim 1 where said vapor removal piston is connected to said rod and further comprising a drive mechanism connected to said rod, said drive mechanism reciproating said rod so that said pumping and vapor removal pistons may be reciprocated.

7. The pump of claim 1 wherein said casing also defines a suction cavity above said sump in communication with said vapor removal suction valve.

8. The pump of claim 1 wherein said casing also defines a discharge cavity in communication with said discharge valve and a discharge line.

9. The pump of claim 1 wherein said pumping cylinder housing outlet is a vapor outlet port in communication with the head space and the pumping cylinder.

10. The pump of claim 1 wherein said pumping cyinder housing inlet is a liquid inlet port in communication with the head space and the pumping cylinder.

11. The pump of claim 10 wherein a pumping chamber is defined within said pumping cylinder by said pumping piston and said pumping cylinder housing; and further comprising a check valve within said pumping cylinder housing and in communication with said pumping chamber and a use line.

12. The pump of claim 11 wherein said pumping piston is hollow with said rod received therein and said rod has a slot formed therein; and further comprising a pin connected to said pumping piston, said pin received in said slot of said rod, and said slot sized so that said rod may move to a limited extent independent of said pumping piston so that vapor may exit from said pumping chamber between the rod and the pumping piston when they are separated as the suction stroke of the pumping piston commences and that liquid may subsequently enter the pumping chamber.

13. The pump of claim 1 wherein said means responsive to said level control for disabling the vapor removal compressor disables the suction valve of the vapor removal compressor.

14. A device for removing vapor from a sump containing a cryogenic pump and a cryogenic liquid with a head space there above comprising:

a. a vapor removal housing positioned above the sump;

b. a vapor removal piston slidably disposed in said vapor removal housing so that upper and lower chambers are defined therein;

c. a rod connected to the piston;

d. a drive mechanism connected to said rod so that said vapor removal piston is moved by said rod in a reciprocating fashion;

e. upper and lower suction valves in communication with the upper and lower chambers, respectively, and adapted to communicate with the head space of said sump;

f. upper and lower discharge valves in communication with the upper and lower chambers, respectively, and a discharge line so that vapor from the head space flows through the discharge line when said vapor removal piston is reciprocated by said rod; and g. level control means sensing the level of cryogenic liquid within the sump and valve disabling means for disabling the suction valves before the level of cryogenic liquid reaches them.

15. The device of claim 14 wherein said level control is a float control positioned within said sump so as to float in any cryogenic liquid there, said float control having a magnet mounted thereto; and said magnet to disable said suction valves when said magnet is positioned near said suction valves.

16. The device of claim 14 wherein an inlet of said sump includes an inlet conduit.

17. The device of claim 14 further comprising a vapor liquid separator postioned within said sump and in communication with said inlet conduit.

18. The device of claim 14 further comprising a casing that defines a suction cavity that is in communication with said upper and lower suction valves and adapted to communicate with the head space of the sump.

19. The device of claim 18 wherein said casing also defines a discharge cavity that is in communication with said upper and lower discharge valves and said discharge line.

20. A method for lifting a cryogenic liquid through an inlet conduit of a pump, where the inlet conduit has an upper end and a lower end, comprising the steps of:

a. directing the cryogenic liquid through the lower end of the inlet conduit so that cryogenic liquid enters the inlet conduit;

b. reducing a pressure at the upper end of the conduit so that vapor is formed from the cryogenic liquid in the inlet conduit and removing the vapor from the upper end of the conduit so that a portion of the cryogenic liquid nearest the upper end of the ilet conduit is cooled by evaporative cooling so that a pressure differential is formed between the cooled portion of the cryogenic liquid and a warmer portion of the cryogenic liquid beneath the cooled portion so that lift for the cryogenic liquid through the inlet conduit is provided.

21. The method of claim 20 further comprising the step of combining the vapor removed from the inlet conduit with vapor removed from the pump and directing the vapor removed from the inlet conduit and the vapor removed from the pump to a use device.

22. The method of claim 20 further comprising the step of directing the vapor removed from the inlet conduit to a source of the cryogenic liquid that is providing the cryogenic liquid to the inlet conduit.

23. A method of separately withdrawing a gaseous phase and a liquid phase of a liquid cryogen fuel from a storage tank for supply to an engine comprising the steps of:

a. providing a vapor removal compressing device;

b. providing a liquid pumping device having an inlet conduit and a low Net Positive Suction Head reciprocating piston pump with an inlet;

c. withdrawing the liquid phase from the storage tank with the liquid pumping device; and d. withdrawing the gaseous phase from the storage tank with the vapor removal compressing device so that the liquid phase in said tank flows through the inlet conduit to at least the inlet of the pump.

24. The method of claim 23 further comprising the step of removing the gaseous phase from a head space of the storage tank with the vapor removal compressing device so that the pressure in the storage tank is reduced whereby a storage life of the storage tank is extended.

25. The method of claim 23 further comprising the step of warming both the gaseous phase and the liquid phase of the liquid cryogen fuel before supplying it to the engine, whereby it is supplied to the engine at an anticipated density.

26. The method of claim 25 further comprising the step of storing the warmed cryogen as a gas at a higher pressure than a minimum pressure desired for subsequent supply as fuel to the engine whereby the fuel is quickly available for use.

27. The method of claim 26 further comprising the step of supplying the gaseous phase to the engine at a lower pressure than the liquid phase, whereby both phases of the liquid cryogen fuel may be burnt as fuel.

* * * * *

UNITED STATES PATENT AND TRADEMARK OFFICE

CERTIFICATE OF CORRECTION

PATENT NO. : 6,663,350 B2
DATED : December 16, 2003
INVENTOR(S) : Lewis Tyree, Jr.

It is certified that error appears in the above-identified patent and that said Letters Patent is hereby corrected as shown below:

Column 14,
Line 3, change “an intake” to -- a discharge --.

Signed and Sealed this

Third Day of February, 2004

JON W. DUDAS
*Acting Director of the United States Patent and Trademark Office*